US006863390B2

(12) United States Patent
Arai et al.

(10) Patent No.: US 6,863,390 B2
(45) Date of Patent: Mar. 8, 2005

(54) HEAD UNIT IN INK JET PRINTER

(75) Inventors: Kenichiro Arai, Nagano (JP); Noboru Otsuki, Nagano (JP)

(73) Assignee: Seiko Epson Corporation, Tokyo (JP)

( * ) Notice: Subject to any disclaimer, the term of this patent is extended or adjusted under 35 U.S.C. 154(b) by 0 days.

(21) Appl. No.: 10/224,584

(22) Filed: Aug. 21, 2002

(65) Prior Publication Data

US 2003/0038868 A1 Feb. 27, 2003

(30) Foreign Application Priority Data

Aug. 21, 2001 (JP) ..... 2001-250655

(51) Int. Cl.[7] ..... B41J 2/17
(52) U.S. Cl. ..... 347/94
(58) Field of Search ..... 347/94, 68, 70, 347/86, 85, 87

(56) References Cited

U.S. PATENT DOCUMENTS 4,558,326 A * 12/1985 Kimura et al. ..... 347/68
5,943,079 A 8/1999 Yoshida
5,969,736 A 10/1999 Field et al.
6,099,111 A * 8/2000 Chang ..... 347/71
6,209,997 B1 4/2001 Duong et al.

FOREIGN PATENT DOCUMENTS

| | | |
|---|---|---|
| EP | 0 855 274 | 7/1998 |
| EP | 1 078 760 | 2/2001 |
| JP | 3-224744 | 10/1991 |
| JP | 4-269553 | 9/1992 |
| JP | 9-141857 | 6/1997 |
| JP | 9-277561 | 10/1997 |
| JP | 11-70667 | 3/1999 |
| JP | 2000-272142 | 10/2000 |
| JP | 2001-199077 | 7/2001 |
| WO | 99/21721 | 5/1999 |

* cited by examiner

*Primary Examiner*—Judy Nguyen
(74) *Attorney, Agent, or Firm*—Nixon & Vanderhye P.C.

(57) ABSTRACT

A head chip has a front face formed with nozzle orifices, and a rear face formed with at least one ink inlet. A damping chamber forming member is laminated on the rear face of the head chip. The damping chamber forming member has at least one damping chamber for dampening pressure fluctuation occurred therein, and an ink supply port for supplying ink from the damping chamber to the head chip.

12 Claims, 4 Drawing Sheets

HEAD UNIT IN INK JET PRINTER

BACKGROUND OF THE INVENTION

The present invention relates to a head unit for a serial type ink jet printer to which ink is supplied from an ink tank, and more particularly to a head unit having a damper mechanism capable of reliably suppressing the fluctuation of ink pressure occurring due to the movement of the head unit. The present invention also relates to an ink jet printer incorporating such a head unit.

In a serial type ink jet printer having a construction in which an ink tank and a head unit mounted on a carriage are connected by a flexible ink tube, when the head unit is moved by the carriage, pressure is applied to the ink which is supplied to the head unit. This pressure is largely dependent on the acceleration of the head unit, the length of an ink passage from the ink tank to the head unit, and the specific weight of the ink. If this pressure is applied to a nozzle orifice of the head unit, it becomes impossible to properly discharge ink droplets, which can cause faulty printing such as the splashing of ink droplets, dot omission or the like.

Accordingly, the head unit is provided with a damper mechanism for absorbing the pressure applied to the ink passage in conjunction with the movement of the head unit. For example, Japanese Patent Publications Nos. 3-224744A and 4-269553A disclose head units having such damper mechanisms.

As disclosed in these publications, the related-art head unit is provided with a shape in which it is elongated in a direction perpendicular to the nozzle formation face. Namely, the related-art head unit is provided with a shape in which it is elongated in a direction perpendicular to the moving direction of the head unit. The reason for this is that it is considered that the damper effect can be obtained efficiently if a damping chamber is disposed in a direction perpendicular to the moving direction of the head unit.

However, the pressure which can be absorbed by the damper mechanism mounted in the head unit is the pressure acting in the ink passage between the damper mechanism and the ink tank, and the pressure acting in the ink passage from the damper mechanism to the nozzle orifice cannot be absorbed. Accordingly, in the case where the head unit is provided with the shape in which it is elongated in the direction perpendicular to the nozzle formation face as in the related art, the ink passage from the damper mechanism to the nozzle orifice becomes long, so that large pressure is produced in the ink passage in conjunction with the movement of the head unit, and is directly transmitted to the nozzle orifice. Hence, such drawbacks as the dot omission have been liable to occur.

In addition, the head unit having a shape in which it is elongated in the direction perpendicular to the moving direction requires much space for its movement, which has constituted a hindrance to the effort to make the ink jet printer compact.

SUMMARY OF THE INVENTION

It is therefore an object of the invention to provide a head unit for an ink jet printer in which an ink passage from the damping chamber forming the damper mechanism to a nozzle orifice is made short.

Another object of the invention is to provide a head unit for an ink jet printer whose dimension in a direction perpendicular to the moving direction thereof is made small.

In order to achieve the above objects, according to the present invention, there is provided an ink jet head unit, comprising:

a head chip, having a front face formed with nozzle orifices, and a rear face formed with at least one ink inlet; and a damping chamber forming member, laminated on the rear face of the head chip, the damping chamber forming member having at least one damping chamber for dampening pressure fluctuation occurred therein, and an ink supply port, which supplies ink from the damping chamber to the head chip through the ink inlet.

In this configuration, since the damping chamber forming member is provided on the rear face of the head chip, it is possible to shorten the length of an ink passage between the head chip and the damping chamber, i.e., the length of the ink supply port. Accordingly, since the pressure applied to the ink passage accompanying the movement of the head unit can be suppressed, it is possible to obviate a decline in the print quality, such as the dot omission.

If the head chip and the damping chamber forming member are made flat so as to elongate in a direction parallel to the front face of the head chip, it is possible to shorten the dimension of the head unit in the direction perpendicular to the moving direction of the head unit. Since it is possible to reduce the space necessary for the movement of the head unit, the ink jet printer can be made compact.

Preferably, the damping chamber is arranged immediately behind the ink inlet of the head chip.

Preferably, the damping chamber forming member includes: a base member, having a front face for mounting the head chip and a rear face formed with at least one recess associated with the ink supply port; and a damping film, laminated on the rear face of the base member such that the damping chamber is defined by the recess and the damping film, the damping film having at least one flexible portion capable of dampening the pressure fluctuation.

Here, it is preferable that the damping film is arranged in substantially parallel with the front face of the head chip.

In this configuration, the length of the ink supply port between the head chip and the damping chamber corresponds to the thickness of the base member. Therefore, if the thickness is made small, the ink passage can be made very short.

In the case where the head unit is mounted in a color ink jet printer, a plurality of recesses may be formed in the base member while being arranged in a direction parallel to the front face. Here, it is possible to shorten the ink passage from each damping chamber to the nozzle orifice, and reduce the dimension of the head unit in the direction perpendicular to the moving direction thereof.

In order to reduce manufacturing cost, it is preferable that the plural recesses are sealed by a single damping film to define a plurality of damping chambers. Alternatively, it is preferable that the damping film has a plurality of flexible portions each associated with at least one damping chamber.

Preferably, the ink jet head unit further comprises an ink supply pipe, inserted into an insertion hole formed in the damping film to supply ink to the damping chamber.

Here, it is preferable that the damping film is made of a rubber film formed with the insertion hole having a size smaller than a size of a tip end portion of the ink supply tube, so that the insertion hole is enlarged when the tip end portion is inserted thereinto.

In the above configurations, the connection between the damping chamber and the ink supply pipe can be effected by a simple operation in which the ink supply pipe is inserted into the insertion hole of the damper film. In addition, since a sealed state is obtained between the ink supply pipe and the damper film by virtue of the resiliency of the damper film, it is unnecessary to provide another measure for sealing these portions. Accordingly, the operation of assembling the ink supply pipe can be facilitated.

Further, it is preferable that a tip end portion of the ink supply pipe is projected into the recess of the base member from the damping film.

In this configuration, it is possible to obviate the drawback that bubbles which entered the damping chamber through the ink supply pipe are accumulated at the tip portion of the ink supply pipe and obstruct the ink supply.

Preferably, the ink jet head unit further comprises a damper holder, which retains the damping film on the base member. The ink supply pipe is integrally formed with the damper holder.

In this configuration, not only the formation of the ink supply passage to the damping chamber and the assembly of the head unit can be simplified, but also the head unit can be made compact.

Preferably, the ink jet head unit further comprises a cover member, for example, box-shaped, having an opening, the cover member accommodating the head chip, the base member, the damping film and the damper holder therein such that the nozzle orifice is exposed from the opening. A first size of the cover member in a direction parallel to the front face of the head chip is larger than a second size of the cover member in a direction perpendicular to the front face of the head chip.

Preferably, each of the head chip and the damping chamber forming member is a flat member elongated in a direction parallel to the front face of the head chip.

According to the present invention, there is also provided an ink jet printer, comprising:

an ink jet head unit, which comprises:

a head chip, having a front face formed with nozzle orifices, and a rear face formed with at least one ink inlet; and a damping chamber forming member, laminated on the rear face of the head chip, the damping chamber having at least one damping chamber for dampening pressure fluctuation occurred therein, and at least one ink supply port, which supplies ink from the damping chamber to the head chip through the ink inlet;

a carriage, which reciprocately moves the ink jet head unit;

an ink tank, which stores ink to be ejected from the nozzle orifice; and a flexible tube, which supplies ink stored in the ink tank to the damping chamber.

BRIEF DESCRIPTION OF THE DRAWINGS

The above objects and advantages of the present invention will become more apparent by describing in detail preferred exemplary embodiments thereof with reference to the accompanying drawings, wherein.

DETAILED DESCRIPTION OF THE PREFERRED EMBODIMENTS

Figure 1:
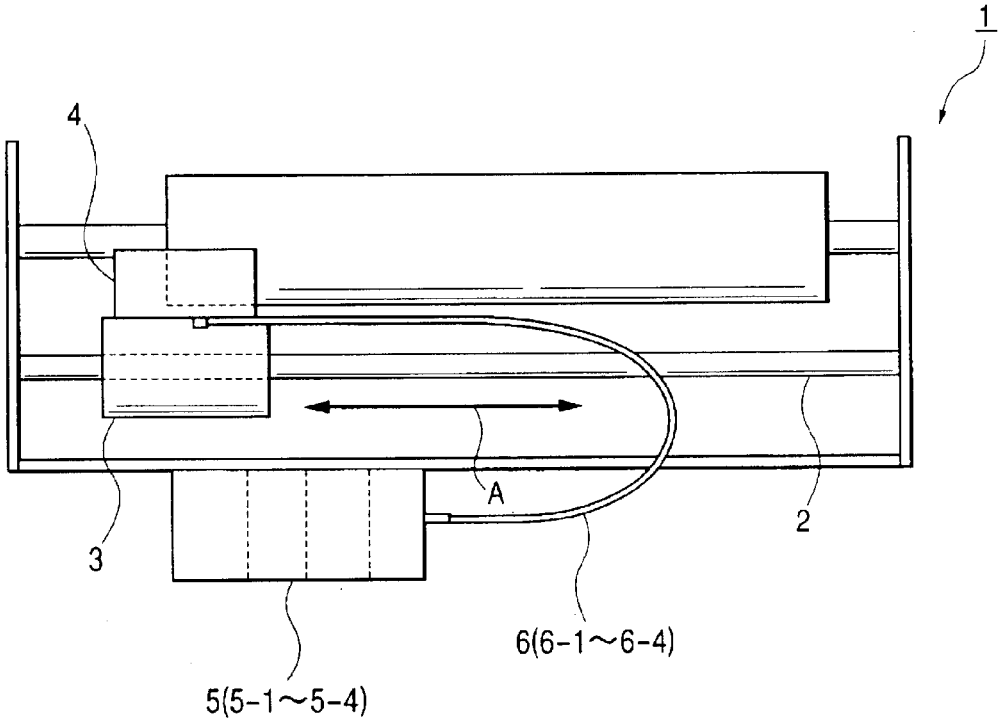
FIG. 1 is a schematic diagram illustrating principal portions of a serial type ink jet printer according to one embodiment of the invention.

Referring now to the drawings, a description will be given of one preferred embodiment of a head unit for an ink jet printer.

As shown in FIG. 1, an ink jet printer 1 in this embodiment is of a serial type, and a head unit 4 is mounted on a carriage 3 capable of reciprocating along a guide shaft 2. Ink is supplied to this head unit 4 through a flexible ink tube 6 from an ink tank 5 disposed in a predetermined position. In this embodiment, ink of four colors including cyan, magenta, yellow, and black is supplied from ink tanks 5-1 to 5-4, in which the ink is respectively stored, to the head unit 4 through four ink tubes 6-1 to 6-4.

The head unit 4 will be explained in detail with reference to FIGS. 2 through 3D. The head unit 4 of this embodiment has a unit cover 11 whose rear face side is open and which has the shape of a rectangular parallelepiped, and a head-unit assembly is accommodated in this unit cover 11.

A head chip 12, a unit base 13, a damper film 14 made of rubber, a damper holder 15, and a relay board 16 are superposed one on top of another in the unit cover 11 in that order from its front face side. Four damping chambers 21(1) to 21(4) are defined by the unit base 13 and the damper film 14. The unit cover 11, the unit base 13, and the damper holder 15 are formed of, for example, resin moldings.

Front end portions 22*a*(1) to 22*a*(4) of ink supply pipes 22(1) to 22(4), which are formed integrally with the damper holder 15, communicate with the respective damping chambers 21(1) to 21(4), while the respective ink tubes 6(1) to 6(4) are connected to rear end portions 22*b*(1) to 22*b*(4) of the ink supply pipes 22(1) to 22(4). The respective damping chambers 21(1) to 21(4) are formed in the head chip 12 so as to communicate with four ink inlets 24(1) to 24(4) via ink supply ports 23(1) to 23(4).

Accordingly, the ink from the ink tanks 5(1) to 5(4) is supplied to the respective damping chambers 21(1) to 21(4) via the ink tubes 6(1) to 6(4) and the ink supply pipes 22(1) to 22(4), and is further supplied from the damping chambers 21(1) to 21(4) to nozzle orifice groups of the respective colors via the ink supply ports 23(1) to 23(4) and the ink inlets 24(1) to 24(4).

The head chip 12 has the shape of a flat rectangular parallelepiped, and its front face 12*a* is the nozzle formation face, where nozzle orifice rows (not shown) for discharging ink of the respective colors are formed. This nozzle formation face 12*a* is exposed from a front face opening 11*a* of the unit cover 11. In addition, flexible wiring boards 25(1) and 25(2) for feeding electric power are led out from side faces of the head chip 12, are led out to the rear side along inner sides of the side faces of the unit cover 11, and are connected to the rear face of the relay board 16. Head-chip driving ICs 26(1) and 26(2) are attached to those portions of the flexible wiring boards 25(1) and 25(2) which are opposed to the respective side faces of the unit cover 11.

The unit base 13 disposed on the rear side of the head chip 12 includes a front wall 31 to which the head chip 12 is bonded and fixed, side walls 32 extending orthogonally from the four edges of this front wall 31 in the rearward direction, and a vertical partition wall 33 and a horizontal partition wall 34 which partition the space defined by the rear face of the front wall 31 and the side walls 32 into a crisscross form.

Figures 3A, 3B:
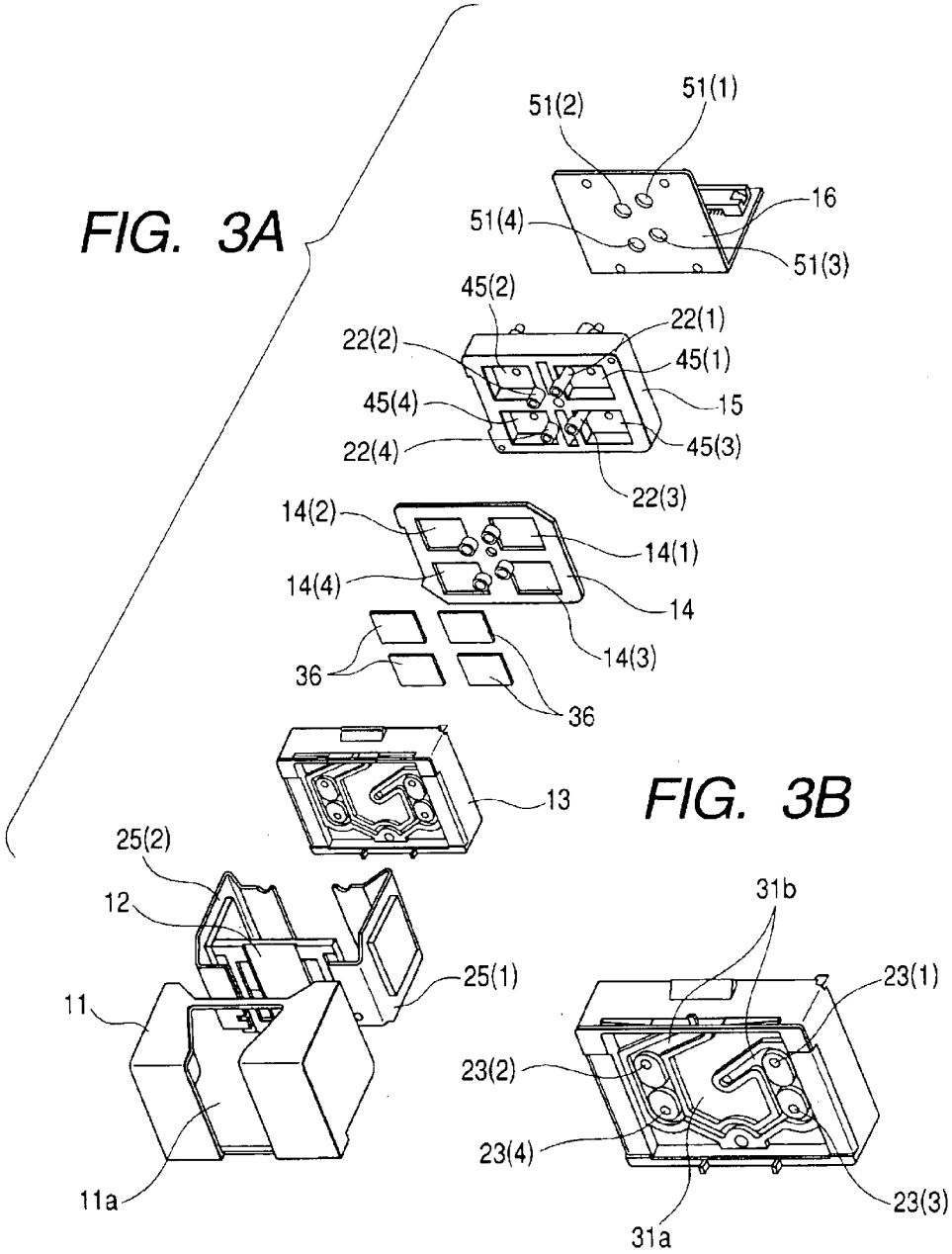
FIG. 3A is an explosive perspective view, as taken from a front side, of the head unit shown in FIG. 2.
FIG. 3B is an enlarged perspective view of a unit base shown in FIG. 3A.

As shown in FIG. 3B, a recessed portion 31*a* to which the head chip 12 is to be fitted is formed in the front face of the front wall 31, bonding grooves 31*b* for filling an adhesive are formed in bottom face of the recessed portion 31*a*, and upper end portions of these bonding grooves 31*b* extend to the upper faces of the side walls 32. The head chip 12 is fitted to the recessed portion 31*a* and is bonded to the front wall 31 by the adhesive filled in the bonding grooves 31*b*.

Four recessed portions 35(1) to 35(4) to be damping chambers are formed in a rear portion of the unit base 13 by the vertical partition wall 33 and the horizontal partition wall 34. These recessed portions are substantially of the identical shape, and the ink supply ports 23(1) to 23(4) formed in the front wall 31 are open to bottom faces 35*a* of the respective recessed portions 35(1) to 35(4). In addition, filters 36 are thermally deposited in such a manner as to cover the bottom faces 35*a*.

Next, the damper film 14 is fixed by being bonded to the rear face of the unit base 13, i.e., rear end faces of the side walls 32, the vertical partition wall 33, and the horizontal partition wall 34. Further, the damper film 14 is pressed against the unit base 13 by the damper holder 15 attached to the rear face side of the damper film 14.

As for the damper film 14, its portions 14(1) to 14(4) opposing the respective recessed portions 35(1) to 35(4) are thin-walled and are deflectable in outward directions of their faces. The recessed portions 35(1) to 35(4) are sealed by the thin-walled portions 14(1) to 14(4) of the damper film 14 to form, the damping chambers 21(1) to 21(4).

The damper holder 15 has a rear wall 41, side walls 42 extending orthogonally from its outer edges in the forward direction, and a vertical partition wall and a horizontal partition wall (neither are shown) which partition the space surrounded by a front face of the rear wall 41 and the side walls 42 into a crisscross form. Four recessed portions 45(1) to 45(4) opposing the damping chambers 21(1) to 21(4) are thereby formed. The recessed portions 45(1) to 45(4) communicate with the atmosphere through ventilation holes 46 formed in the rear wall 41. The thin-walled portions 14(1) to 14(4) of the damper film 14 are freely deflectable in outward directions of their faces by the aforementioned recessed portions 45(1) to 45(4).

Here, in the damper holder 15 in this embodiment, the four ink supply pipes 22(1) to 22(4) are formed integrally with its portion 47 where the vertical and horizontal partition plates cross, and the damper holder 15 is formed of, for example, a resin molding. The rear-end portions 22*b*(1) to 22*b*(4) of the ink supply pipes 22(1) to 22(4) project to the rear side by passing through holes 51(1) to 51(4) formed in the relay board 16, and are connected to the ink tubes 6(1) to 6(4). In contrast, the tip portions 22*a*(1) to 22*a*(4) of the ink supply pipes 22(1) to 22(4) are passed through insertion holes 52(1) to 52(4) formed in the damper film 14, and project into the respective damping chambers 21(1) to 21(4). The insertion holes 52(1) to 52(4) project into the respective damping chambers 21(1) to 21(4) and have predetermined lengths, and their inside diameters are formed to be slightly smaller than the outside diameters of the front end portions 22*a*(1) to 22*a*(4) of the ink supply pipes 22(1) to 22(4).

Accordingly, the portions of the damper film 14 where the insertion holes 52(1) are formed are in close contact with outer peripheral faces of the front end portions 22*a*(1) to 22*a*(4) by the resilient restoring force of the damper film 14 itself, so that the faces of contact between the damper film 14 and the front end portions 22*a*(1) to 22*a*(4) are in a completely sealed state.

Figure 2:
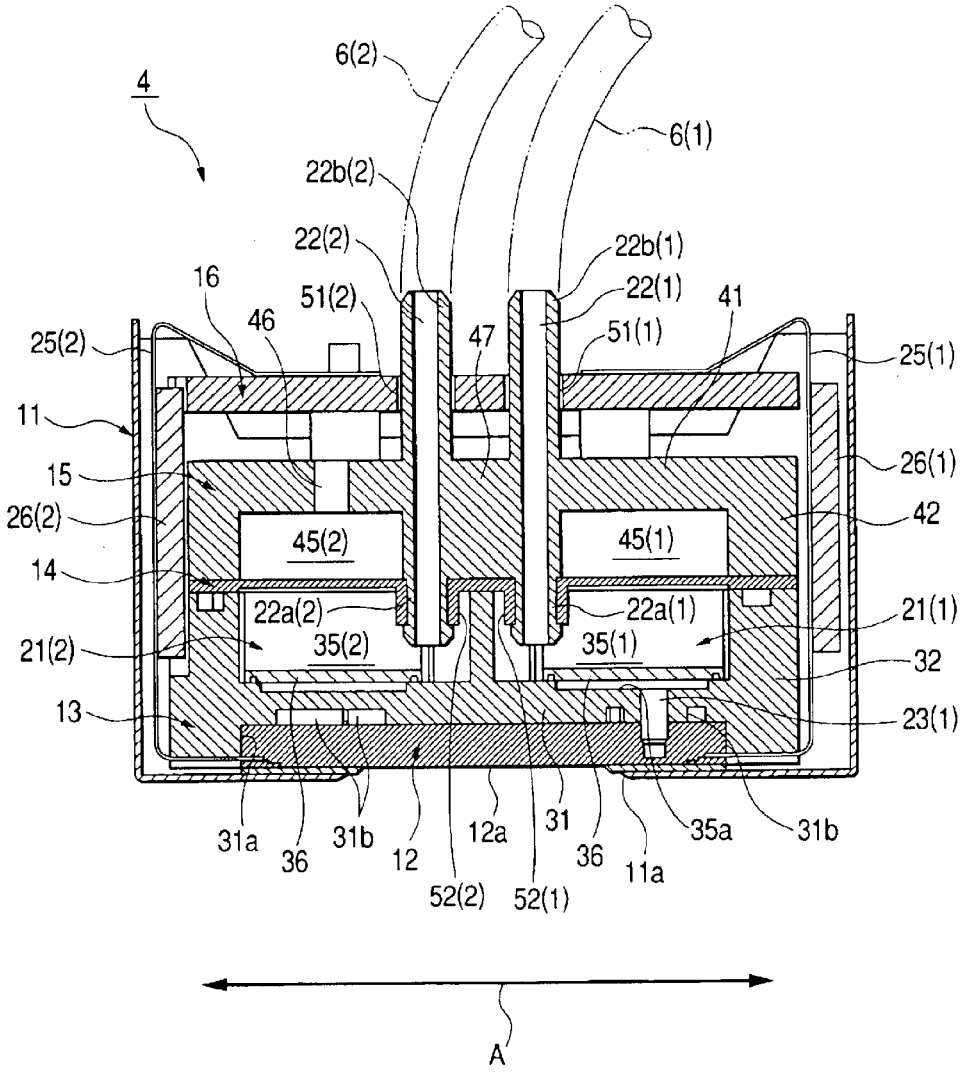
FIG. 2 is a cross-sectional view illustrating a head unit in the ink jet printer shown in FIG. 1.
Figures 3C, 3D:
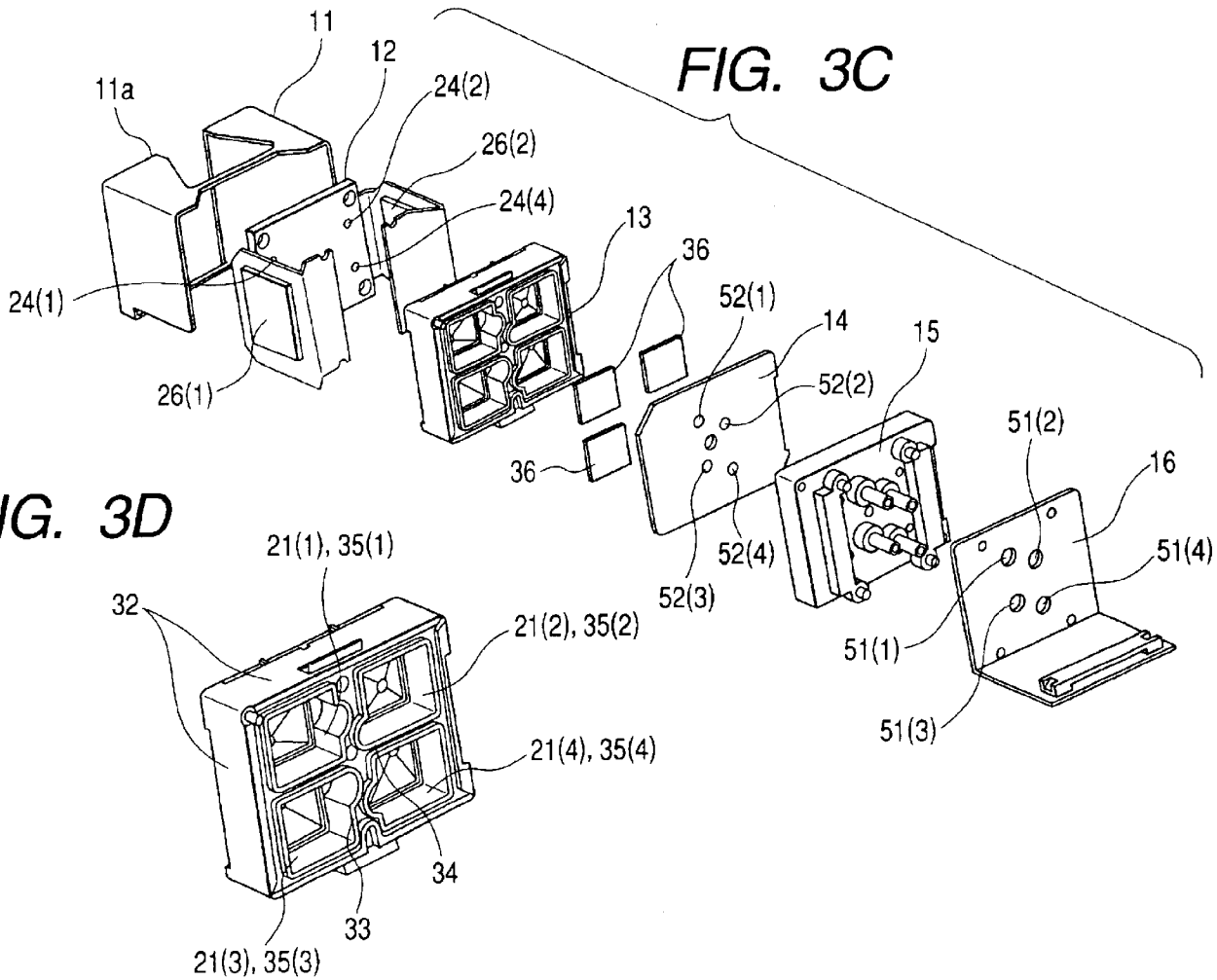
FIG. 3C is an explosive perspective view, as taken from a rear side, of the head unit shown in FIG. 2.
FIG. 3D is an enlarged perspective view of the unit base shown in FIG. 3C.

The thus constructed head unit 4 performs ink ejection while moving in the directions indicated by arrows A in FIGS. 1 and 2. The fluctuation of pressure applied to the ink inside the ink tube 6 is absorbed or alleviated by the four damping chambers 21(1) to 21(4) provided in the head unit 4. In addition, those portions for which the damping effect by the damping chambers 21(1) to 21(4) cannot be expected are passages extending from the damping chambers 21(1) to 21(4) to front ends of the ink supply ports 23(1) to 23(4) leading to the head chip 12, but the length of these passages is very short. Hence, since the pressure applied to the ink in these portions is very small, no adverse effect is exerted on the discharging of ink droplets from the nozzle orifice. Accordingly, it is possible to reliably prevent faulty printing such as the dot omission caused by pressure fluctuations of ink accompanying the movement of the head unit 4.

In this embodiment, by making the thickness of the front wall 31 of the unit base 13 small, it is possible to shorten the ink supply ports 23(1) to 23(4) formed therein. In principle, the ink supply ports can be shortened down to a thickness necessary for forming the bonding grooves 31*b*.

In addition, in this embodiment, the four damping chambers 21(1) to 21(4) are arrayed in a direction parallel to the nozzle formation face 12*a* of the head chip 12, i.e., along the moving direction of the head unit 4, and each of the damping chambers 21(1) to 21(4) has a shape in which it is more elongated in a direction parallel to the nozzle formation face 12*a* than in a direction perpendicular thereto. Hence, the component parts for the head unit 4 can be incorporated within the unit cover 11 having the shape of a rectangular parallelepiped which is more elongated in the direction parallel to the moving direction of the head chip 4 than in the direction perpendicular thereto. Consequently, since it is possible to structure a head unit whose dimension in the direction perpendicular to the moving direction is small, it is possible to reduce the space necessary for its movement, thereby making the ink jet printer compact.

Further, the damper film 14 is formed by a single rubber film with respect to the four damping chambers 21(1) to 21(4). For this reason, the four damping chambers 21(1) to 21(4) can be easily provided with seals by the damper film 14 at the side walls 32, the vertical partition wall 33, and the horizontal partition wall 34.

Next, in this embodiment, the ink supply pipes 22(1) to 22(4) are formed integrally with the damper holder 15, and the ink supply passages to the respective damping chambers 21(1) to 21(4) can be formed by the simple operation in which these supply pipes are inserted in the insertion holes 52(1) to 52(4) formed in the damper film 14. Hence, the assembly of the head unit 4 can be performed easily. In addition, since the structure of the portions of the ink supply passages can be simplified, this arrangement is advantageous in making the head unit compact.

In addition, in this embodiment, by making use of the resiliency of the damper film 14, seals are formed between the insertion holes 52(1) to 52(4) formed in the damper film 14 and the ink supply pipes 22(1) to 22(4) inserted therein. Accordingly, it is unnecessary to attach separate members for forming the sealed state, and the sealed state is automatically formed by merely inserting the ink supply pipes. Hence, the assembly operation of the head unit is made simple, and it is possible to decrease the number of components and realize a compact size and lower cost.

Furthermore, in this embodiment, the front end portions 22*a*(1) to 22*a*(4) of the ink supply pipes 22(1) to 22(4) are made to project into the damping chambers 21(1) 21(1) to 21(4) by a predetermined length. In this arrangement, it is possible to obviate the drawback that bubbles which entered the damping chambers 21(1) to 21(4) through the ink supply pipes 22(1) to 22(4) are accumulated at the tips of the ink supply pipes 22(1) to 22(4) and obstruct the ink supply. Namely, since the tips of the ink supply pipes 22(1) to 22(4) project from the remaining inner peripheral face portions of the damping chambers, the bubbles accumulated in these portions are in an unstable state, and are therefore likely to move from these portions to the inner peripheral face portions of the damping chambers.

Although the above-described embodiment concerns the head unit mounted in the ink jet printer performing color printing in four colors, the invention is similarly applicable to the head unit for the ink jet printer performing single color printing or printing with a plurality of colors other than the four colors.

It should be noted that the invention is not limited to the above-described embodiment, and various modifications are possible.

For example, although the damper film 14 for the four damping chambers 21(1) to 21(4) is formed by a single rubber film, two rubber films each associated with two damping chambers may be used, but the fewer the number of films, the more it is possible to contribute to the cost reduction.

In addition, although the example is used in which the number of the damping chambers 21(1) to 21(4) is four, even if a single damping chamber is used, if an arrangement is provided such that a flat damping chamber is superposed on the rear portion of the head chip formed in the flat shape, the pressure applied to the ink passage can be made into a very small force. Therefore, it is possible to obviate a decline in the print quality such as the dot omission, and shorten the dimension of the head unit in the direction perpendicular to the moving direction (the direction of the nozzle formation face).

What is claimed is:

1. An ink jet head unit, comprising:

a head chip, having a front face formed with nozzle orifices, and a rear face formed with at least one ink inlet; and a damping chamber forming member, laminated on the rear face of the head chip, the damping chamber forming member having at least one damping chamber for dampening pressure fluctuation occurred therein, and at least one ink supply port, which supplies ink from the damping chamber to the head chip.

wherein the damping chamber forming member includes:

a base member, having a front face for mounting the head chip and a rear face formed with a plurality of recesses arranged in a direction parallel to the front face of the head-chip and associated with the ink supply port; and a damping film, laminated on the rear face of the base member such that the damping chamber is defined by the recess and the damping film, the damping film having at least one flexible portion capable of dampening the pressure fluctuation.

2. The ink jet head unit as set forth in claim 1, wherein the damping chamber is arranged immediately behind the ink inlet of the head chip.

3. The ink jet head unit as set forth in claim 1, wherein the damping film is arranged in substantially parallel with the front face of the head chip.

4. The ink jet head unit as set forth in claim 1, wherein the plurality of recesses are sealed by a single damping film to define a plurality of damping chambers.

5. The ink jet head unit as set forth in claim 4, wherein the damping film has a plurality of flexible portions each associated with at least one of the damping chambers.

6. The ink jet head unit as set forth in claim 1, further comprising an ink supply pipe, inserted into an insertion hole formed in the damping film to supply ink to the damping chamber.

7. The ink jet head unit as set forth in claim 6, wherein the damping film is comprised of a rubber film formed with the insertion hole having a size smaller than a size of a tip end portion of the ink supply pipe, so that the insertion hole is enlarged when the tip end portion is inserted thereinto.

8. The ink jet head unit as set forth in claim 6, wherein tip end portion of the ink supply pipe is projected into the recess of the base member from the damping film.

9. The ink jet head unit as set forth in claim 6, further comprising a damper holder, which retains the damping film on the base member, wherein the ink supply pipe is integrally formed with the damper holder.

10. The ink jet head unit as set forth in claim 9, further comprising a cover member having an opening, the cover member accommodating the head chip, the base member, the damping film and the damper holder therein such that the nozzle orifices are exposed from the opening, wherein a first size of the cover member in a direction parallel to the front face of the head chip is larger than a second size of the cover member in a direction perpendicular to the front face of the head chip.

11. The ink jet head unit as set forth in claim 1, wherein each of the head chip and the damping chamber forming member is a flat member elongated in a direction parallel to the front face of the head chip.

12. An ink jet printer, comprising:

an ink jet head unit, which comprises:

a head chip, having a front face formed with nozzle orifices, and a rear face formed with at least one ink inlet; and a damping chamber forming member, laminated on the rear face of the head chip, the damping chamber forming member having at least one damping chamber for dampening pressure fluctuation occurred therein, and at least one ink supply port, which supplies ink from the damping chamber to the head chip, wherein the damping chamber forming member includes:

a base member, having a front face for mounting the head chip and a rear face formed with a plurality of recesses arranged in a direction parallel to the front face of the head chip and associated with the ink supply port; and a damping film, laminated on the rear face of the base member such that the damping chamber is defined by the recess and the damping film, the damping film having at least one flexible portion capable of dampening the pressure fluctuation;

a carriage, which reciprocately moves the ink jet head unit;

an ink tank, which stores ink to be ejected from the nozzle orifices; and a flexible tube, which supplies ink stored in the ink tank to the damping chamber.

* * * * *